United States Patent [19]

Dunagan et al.

[11] Patent Number: 5,007,199

[45] Date of Patent: Apr. 16, 1991

[54] ANTI-INTRUSION WINDOW

[75] Inventors: John E. Dunagan, Solon; Stanley Bernath, Pepper Pike, both of Ohio

[73] Assignee: Larmco Security, Inc., Walton Hills, Ohio

[21] Appl. No.: 480,238

[22] Filed: Feb. 15, 1990

[51] Int. Cl.[5] ..... G08B 13/08

[52] U.S. Cl. ..... 49/13; 340/547

[58] Field of Search ..... 49/13, 14; 340/547, 340/545, 546

[56] References Cited

U.S. PATENT DOCUMENTS

| | | | |
|---|---|---|---|
| 700,812 | 5/1902 | Peyton . | |
| 2,826,656 | 3/1958 | Gordon . | |
| 2,877,361 | 3/1959 | Chase . | |
| 2,912,540 | 11/1959 | Sawicki . | |
| 2,922,150 | 1/1960 | Jezl . | |
| 2,924,682 | 2/1960 | Winterburn . | |
| 3,161,742 | 12/1964 | Bagno . | |
| 3,305,805 | 2/1967 | Tann . | |
| 3,345,627 | 10/1967 | Herst et al. . | |
| 3,378,830 | 4/1968 | Patrick . | |
| 3,410,245 | 11/1968 | Kashden et al. . | |
| 3,426,166 | 2/1969 | Canceill . | |
| 3,470,554 | 9/1969 | Corbell . | |
| 3,596,021 | 7/1971 | Saul . | |
| 3,710,369 | 1/1973 | Takahashi . | |
| 3,742,479 | 6/1973 | Williams . | |
| 3,768,087 | 10/1973 | Kaye et al. . | |
| 3,771,152 | 11/1973 | Dettling et al. . | |
| 3,772,669 | 11/1973 | Johnston et al. . | |
| 3,778,806 | 12/1973 | Williams . | |
| 3,896,404 | 7/1975 | Peterson . | |
| 3,943,485 | 3/1976 | Waldman . | |
| 3,986,183 | 10/1976 | Fujiwara . | |
| 3,993,988 | 11/1976 | Walter . | |
| 4,160,972 | 6/1979 | LaMell et al. . | |
| 4,271,338 | 6/1981 | Rakocy | 340/547 X |
| 4,271,405 | 6/1981 | Kitterman | 340/547 X |
| 4,292,629 | 9/1981 | Kerr et al. | 340/547 |
| 4,335,375 | 6/1982 | Schaeffer . | |
| 4,438,430 | 3/1984 | Young et al. . | |
| 4,472,709 | 9/1984 | White . | |
| 4,495,486 | 1/1985 | White . | |
| 4,686,792 | 8/1987 | Terrian | 49/13 X |
| 4,891,626 | 1/1990 | Neuman | 49/13 X |

FOREIGN PATENT DOCUMENTS

| | | |
|---|---|---|
| 1161183 | 1/1964 | Fed. Rep. of Germany . |

*Primary Examiner*—Philip C. Kannan

*Attorney, Agent, or Firm*—Watts, Hoffmann, Fisher & Heinke Co.

[57] ABSTRACT

An anti-intrusion window is disclosed having a sash assembly which is movable along two paths; one for ventilating and one for cleaning the sash. A sensor is supported by one of the window frame or the sash assembly and a position indicator such as a magnet is supported by the other. The sensor detects the momentary presence of the position indicator to trigger an alarm. The sash assembly is movable through a range of ventilating positions without triggering the alarm while the alarm is armed. The sash may be moved into a cleaning position without triggering the alarm while the alarm is armed.

28 Claims, 5 Drawing Sheets

ANTI-INTRUSION WINDOW

BACKGROUND OF THE INVENTION

1. Field of the Invention

This invention relates to replacement windows and more particularly to replacement windows having built-in intrusion alarm systems.

2. Description of the Related Art

Intrusion alarms for windows and doors are typically designed so that window or door movement from a closed position actuates the alarm. Usually a switch is closed by the movement to initiate the alarm as disclosed in U.S. Pat. No. 3,742,479 to Williams. This arrangement requires, in the case of windows, disabling the alarm before opening the window for ventilation purposes or for cleaning. When such windows are opened for ventilation, there is no alarm protection against intruders.

In some prior art proposals, after a window is opened and an alarm is sounded, reclosing the window discontinues the alarm. When a potential intruder opens such a window the alarm may quickly be shut off by the intruder closing the window. In such circumstances a prowler might not be frightened away by the alarm and the prowler's presence not adequately signalled.

Some window alarms are mounted on the window frame. See, for example, U.S. Pat. No. 4,472,709 to White and U.S. Pat. No. 3,378,830 to Patrick. This can result in an unsightly window and may permit tampering with the exposed alarm system by an intruder. Some alarms are constructed to be installed within an existing door or window. For example, see U.S. Pat. No. 3,768,087. Here an installation job is required to place the alarm and tools are necessary to remove the alarm for maintenance or repair.

The present invention provides a new and improved replacement window having an intrusion alarm system enabling the window to be opened in such a way that an alarm is not triggered yet intruders can not enter.

SUMMARY OF THE INVENTION

In a preferred and illustrated embodiment of the invention, the new anti-intrusion window comprises a frame assembly constructed for mounting in a building structure, a sash assembly supported by the frame assembly for movement with respect to the frame assembly along a path of travel, a position indicator supported by one assembly, and a sensor supported by the other assembly so that the sensor and the position indicator move with respect to one another when the sash assembly is moved along the path. The anti-intrusion window further comprises an alarm system having an armed condition for triggering an alarm in response to momentary presence of the position indicator near the sensor as the sash assembly moves relative to the frame assembly along the travel path.

The sash assembly is movable between a closed position and a range of open, ventilating positions along the path. The position indicator and sensor remain spaced apart throughout the range of ventilating positions so the alarm system remains armed but not triggered when the sash assembly is open for ventilation, but is not opened enough to accommodate an intruder.

The sash assembly may also be movable with respect to the frame assembly along a second travel path to enable cleaning the window pane from within the building without triggering the alarm system. The sensor and the position indicator are supported so that sash movement along the second path to a cleaning position maintains the position indicator and the sensor spaced apart sufficiently that momentary presence of the position indicator near the sensor is avoided. This prevents the alarm system from triggering even though the alarm system remains armed during window cleaning.

The alarm system of the anti-intrusion window comprises an alarm unit, a power supply, alarm circuitry, and a key. The alarm system responds to a signal from the sensor indicating a predetermined degree of movement of the sash assembly. The key arms and disarms the alarm system.

An important feature of the new window is that the alarm system comprises an alarm unit removably mounted within one of the sash or frame assemblies so the appearance of the window is not adversely effected by the presence of the alarm unit. In the illustrated embodiment, the sensor is supported by the alarm unit. According to a preferred embodiment a latching arrangement secures the alarm unit in place while enabling its quick and easy removal and replacement.

The alarm circuitry of the alarm system comprises a signal processing circuit, a status circuit, an alarm driver circuit, and, optionally, a radio frequency transmitter. The signal processing circuit is comprised of a latching circuit which produces an alarm condition signal and a signal conditioning circuit which operates the alarm driver circuit in response to the alarm condition signal. The latching circuit is constructed to produce the alarm condition signal until the alarm system is reset.

The preferred alarm system key latches in place to maintain the alarm system disarmed. Removing the key arms the alarm system. After the alarm system is triggered, momentarily inserting the key resets the alarm system.

DESCRIPTION OF THE PREFERRED EMBODIMENT

Figure 1:
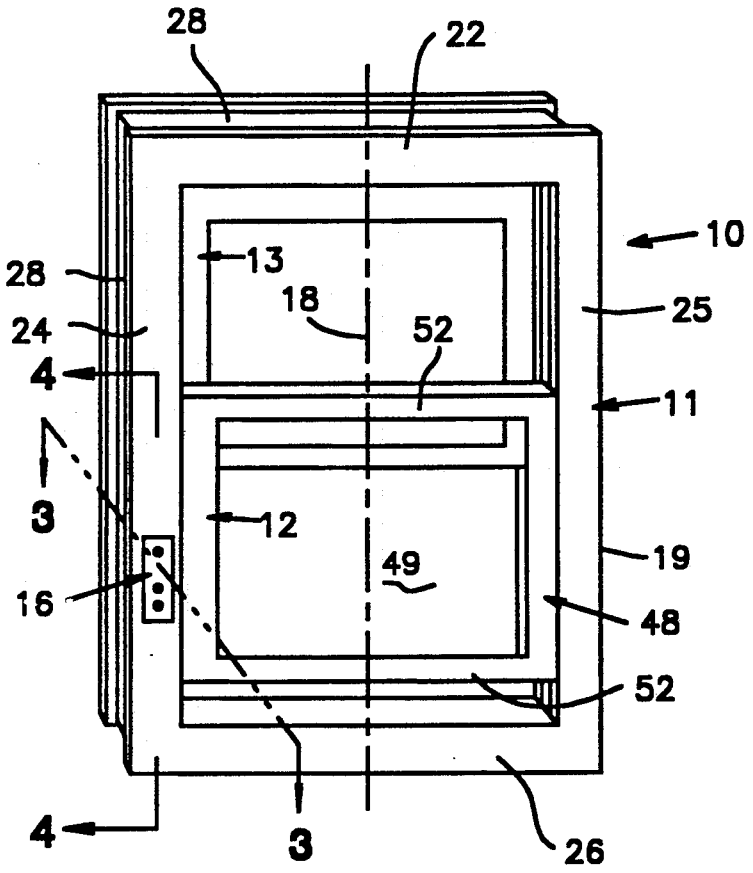
FIG. 1 is a perspective view of an anti-intrusion window constructed according to a preferred embodiment of the invention with a sash assembly in a ventilating position relative to the frame assembly.
Figure 2:
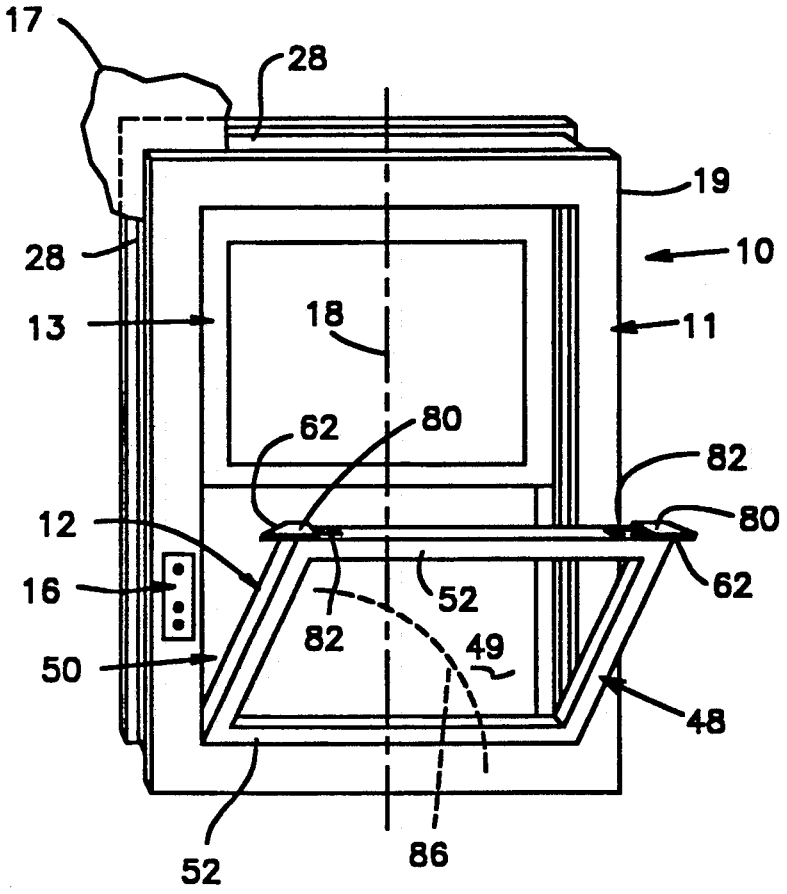
FIG. 2 is a perspective view of the window of FIG. 1 with the sash assembly positioned for enabling the glazing to be cleaned easily from inside.
Figure 3:
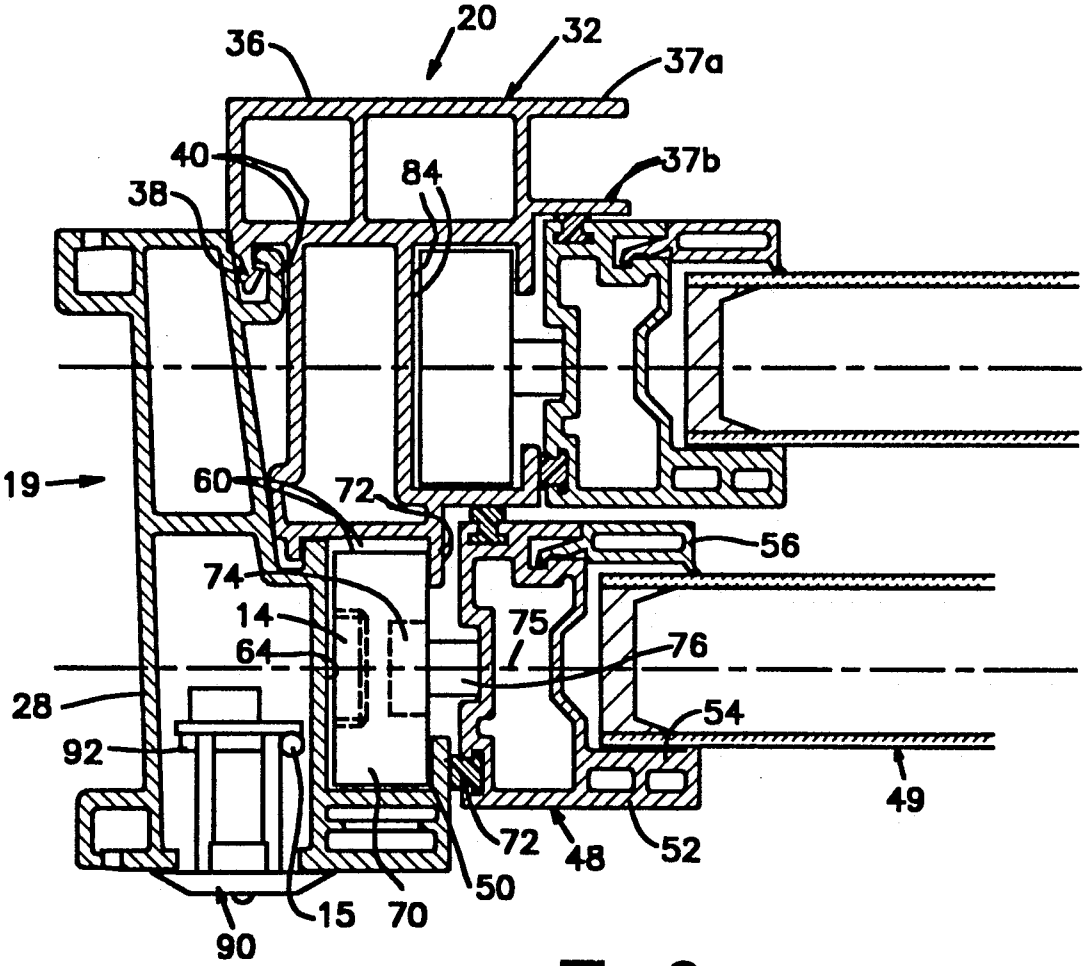
FIG. 3 is a fragmentary cross sectional view seen approximately from the plane indicated by the line 3—3 of FIG. 1.

An anti-intrusion replacement window 10 embodying the present invention is illustrated by the drawings as a double-hung window constructed for mounting in a window opening formed in a building structure. Referring to FIGS. 1-3, the new window 10 comprises a window frame assembly 11, a lower sash assembly 12, an upper sash 13, a position indicator 14 (FIG. 3) supported by one assembly, a sensor 15 (FIG. 3) supported by the other assembly and, an alarm system 16, including an alarm producing device, for triggering an alarm in response to the momentary presence of the position indicator 14 near the sensor 15.

The illustrated frame assembly and the sashes are of a conventional, commercially available design which may be obtained, for example, from the assignee of this application and are known as "Stanley Windows model 400 welded." Because these components are conventional they are described relatively briefly and primarily in terms of their relationship to the alarm system 16, the position indicator 14 and the sensor 15. Furthermore it should be understood that, although a double-hung window is disclosed here, the invention is equally applicable to other types of replacement windows such as single-hung windows, so called "sliders," etc.

The frame assembly 11 maintains the remaining window components assembled as a unit and is constructed and arranged so it can readily be secured to the building wall 17 (FIG. 2) in the place of an original window frame structure. The frame assembly 11 is an open rectangular structure surrounding and supporting both the sash assembly 12 (sometimes referred to as the "lower" sash) and the sash 13 (sometimes referred to as the "upper" sash) for sliding movement from their closed positions along respective paths of travel generally indicated by the line 18.

Figure 8:
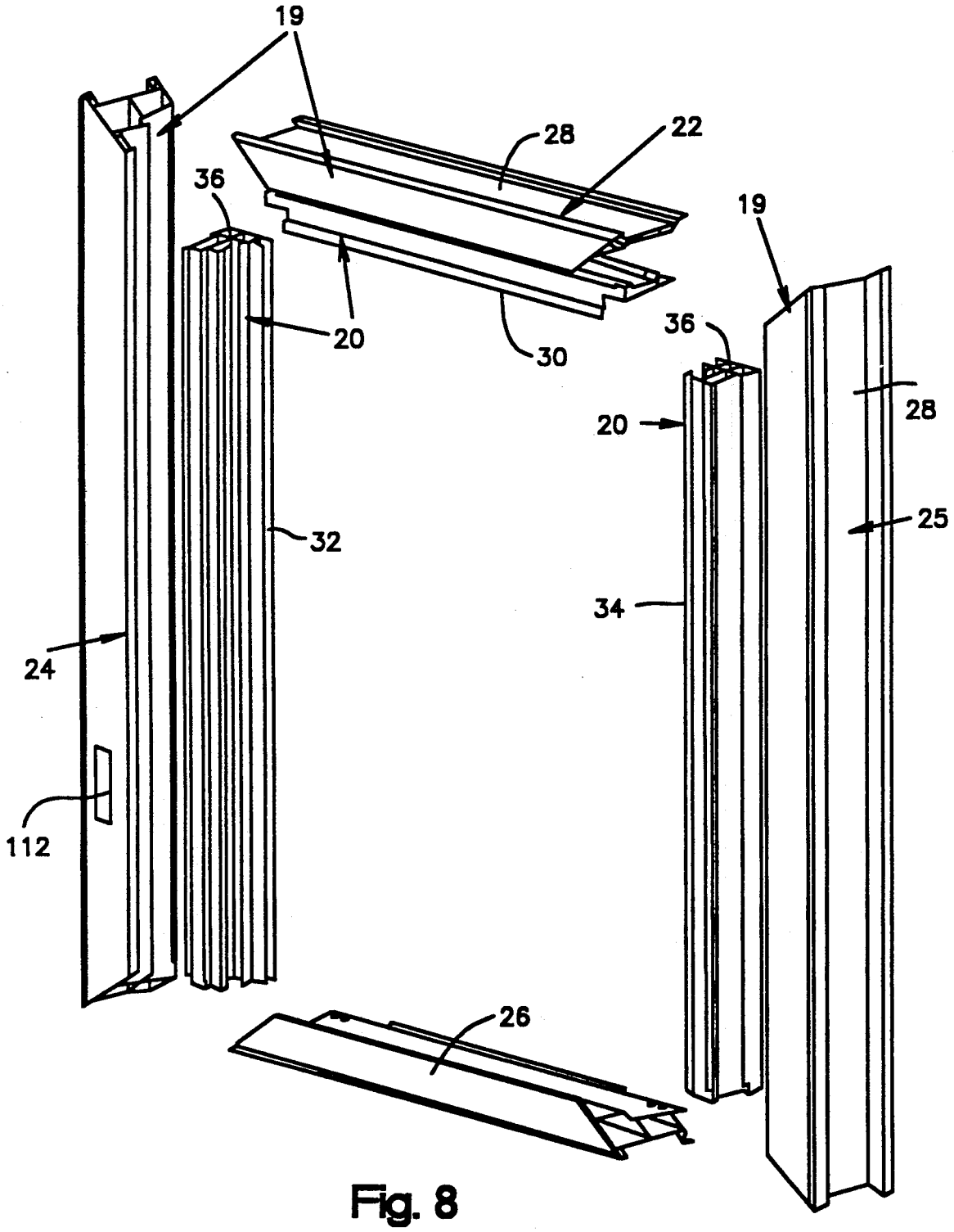

The frame assembly 11 comprises a base frame 19 secured to the building wall and an adaptor frame 20 (see FIG. 8) secured to and coacting with the base frame 19 to support the upper and lower sashes.

The base frame assembly 19 comprises a head 22 at the per side of the window, jambs 24, 25 forming opposite sides of the window, respectively, and a sill 26 extending between the jambs to form the lower side of the window. The head, jambs and sill are formed by extruded thermoplastic members having their adjoining ends mitered and welded together to form a flat rectangular frame structure. The head, jambs and sill are essentially hollow tubular structures formed with outer walls supported by stiffening webs and flanges configured so that their cross sectional shapes mate sufficiently at the mitered corners to assure a strong weld joint and a desired external surface configuration. Each extruded member has an external longitudinal channel so that the base frame assembly 19 defines a continuous circumferentially extending channel 28 receiving the building wall structure 17.

The adaptor frame 20 (FIGS. 3 and 8) is constructed and arranged to interfit with the base frame 19 for maintaining the sashes securely assembled in the window and comprises a head adaptor 30 and jamb adapters 32, 34. The adaptor members are formed by extruded tubular thermoplastic members having their adjacent ends mitered and welded together to form a flat rectilinear frame structure which is open along the "lower" side where the sill 26 extends between the free ends of the jamb adapters. The adapters form outer surfaces 36 which face outwardly from the building when the window is installed. The inner periphery of the adaptor frame is formed in part by spaced flanges 37*a*, 37*b* defining a channel between them for receiving a window screen. The flanges 37*b* also define a guide surface along which the upper sash extends.

The adaptor frame 20 is securely fixed to the based frame 19 during fabrication of the window 10. Each adaptor defines a latching flange 38 (FIG. 3) projecting into a keeper flange structure 40 on the base frame when the adaptor frame 20 is pressed into the base frame assembly. This coaction permanently locks the frame assembly components together while providing structure for movably supporting the upper and lower sashes.

The sash assembly 12 normally occupies the lower portion of the window area adjacent the sill and comprises a sash frame 48, glazing, in the form of an insulating glass unit 49, fixed in the sash frame, and a mechanism 50 (FIG. 3) for movably mounting the sash assembly to the window frame assembly 11. In the illustrated window 10 the sash frame 48 comprises a rectangular sash body formed by extruded thermoplastic tubular members 52 having mitered ends welded together to form sash corners. The inner periphery of the sash frame is defined by a support flange 54 in sealing engagement with the insulating glass unit 49. The unit 49 is clamped in place by retainer frame members 56 (FIG. 3) which are locked to the sash frame and seal against the unit 49.

The insulating glass unit 49 is a conventionally constructed unit which forms no part of the invention. It is schematically illustrated and not described in detail.

The mechanism 50 secures the sash assembly 12 to the frame assembly 11 so that the sash is readily movable relative to the frame assembly. In the illustrated window 10 the mechanism 50 comprises a slide assembly 60 (FIG. 3) movably connected to the frame assembly 11 and at each lower corner of the sash frame, a sash guide 62 (see FIG. 2) engaged between the sash 12 and the frame assembly 11 at each upper corner of the sash 12, and a spring unit (not shown) reacting between the slide assembly and the frame assembly 11 for simulating a window sash counterweight when the sash is raised from its closed position.

Each slide assembly 60 (FIG. 3) guides the sash during movement along the path of travel 18 and is disposed in a guiding trackway 64 extending along the jamb from top to bottom and formed by the juncture of the base frame 19 and the adaptor frame 20. Each slide assembly 60 comprises a shoe 70 slidably disposed in the trackway 64 and captured there by retainer flanges 72, a bushing 74 supported by the shoe 70 for rotation about a bushing axis 75, and a support trunnion 76 anchored to the sash at a lower corner and projecting into the bushing 74 along the bushing axis 75.

Each sash guide projects into the trackway 64 from an upper sash corner to coact with the slide assembly in guiding movement of the sash along the travel path 18. The preferred and illustrated sash guide (FIG. 2) comprises a guide finger 80 supported on the upper side of the sash frame at the sash frame corner with a free end projecting into the trackway. Each finger is biased to its trackway engaging position by a spring 82.

The counterweight simulating spring units are of conventional commercially available construction and prevent the sashes from shifting in their trackways under the force of gravity. These spring units are disposed in the trackways out of sight and since they form no part of the present invention they are neither illustrated nor described further.

The upper sash 14 is disposed in trackways 84 formed in the adaptor frame 20 (see FIG. 3). The upper sash is constructed similarly to the lower sash 12 and therefore a detailed description of the upper sash construction is omitted for the sake of brevity.

The upper and lower sashes are constructed so they can be shifted relative to the frame assembly 11 to cleaning positions where the "outside" of the window glazing is readily accessible to a window cleaner inside the building. In the illustrated window the sashes are shifted to the cleaning position by manually retracting the guide fingers 80 against the biasing spring 82 from their respective trackways and then pivoting the upper side of the sash into the building about the bushing axis 75. The sash thus moves to its cleaning position along an arcuate path of travel indicated by the line 86 in FIG. 2. Once cleaned, the sash is pivoted back to its normal position in the frame assembly and the guide fingers latch into their respective trackways to secure the sash in place again.

The position indicator 14 and the sensor 15 cooperate so that whenever the sash assembly 12 is moved from its closed position along the travel path 18 to, or beyond, a location where the position indicator and the sensor are proximate each other, even momentarily, an alarm is triggered. In the preferred embodiment of the invention the position indicator 14 is mounted on the sash assembly 12 for movement with the sash relative to the frame assembly 11, while the sensor 15 is mounted on the frame assembly 11 at a location chosen so that the sash assembly 12 can be opened to a ventilating position or shifted to its cleaning position without triggering the alarm.

In the preferred and illustrated embodiment, the position indicator 14 is formed by a permanent magnet fixed to one shoe 70 of the slide assembly 60. The magnet is preferably a flat cylindrical member received in a conforming recess in the shoe. The recess opens toward the base wall of the trackway 44 so the magnet is confined in the recess by the trackway wall. Thus whenever the sash assembly 12 is moved in the direction of the travel path 18 the magnet is shifted along the base wall of the trackway 64 relative to the frame assembly 11. Whenever the sash assembly 11 is shifted to its cleaning position the shoe 70 remains stationary as the sash frame and glazing rotate about the bushing axis 75. Thus the magnet does not move relative to the frame assembly 11 when the window is moved to its cleaning position.

The sensor 15 of the preferred embodiment is a magnetically responsive reed switch (see FIGS. 3 and 4) fixed to the frame assembly 11 adjacent the trackway 44 and elevated a predetermined distance away from the sill 26. When the position indicator 14 moves sufficiently close to the reed switch, the magnetic field acts upon and closes the reed switch contacts triggering an alarm. The alarm is triggered even if the position indicator 14 is momentarily in the vicinity of the switch contacts because the reed switch contacts are highly sensitive to magnetic fields and the alarm, once triggered, must be manually reset. The location of the sensor 15 relative to the sill 26 is chosen so that the sash assembly 11 can be raised from its closed position sufficiently to permit building ventilation yet not so far open that an intruder may enter through the window.

The alarm system 16 is built into the frame assembly 11 so that when the window 10 is installed as a replacement, a fully operational alarm is provided as well. The preferred alarm system is manually controlled by the building occupant, signals its operational status when armed to produce an alarm, is easily installed during manufacture and can be removed and replaced by the building occupant for servicing when appropriate. The illustrated alarm system 16 is best seen in FIGS. 3–7 and comprises a support unit 90 detachably connected to the frame assembly 11, alarm circuitry 92 supported by the unit 90 within the frame assembly, an operating key 94, and a power supply 96.

The support unit 90 is constructed and arranged so that it is readily installed in the window frame assembly during manufacturing, provides a decorative yet functional control panel and structurally supports the circuitry 92, the power supply 96 and the sensor 15. The support unit comprises a base plate 100, circuitry supporting legs 102 projecting from the base plate, connecting structure 104 by which the unit 90 is secured to the window frame assembly, and a control panel portion 106 defining an operating key receptacle 108 and a supporting opening for a status indicator 110.

The base plate 100 is a generally rectangular molded plastic member seated on the jamb inside of the building and positioned to cover a rectangular alarm system receiving opening 112 formed in the jamb. The side of the base plate facing the building interior forms the control panel portion 106 while the opposite side of the plate engages the jamb along its peripheral margin. The legs 102 project from spaced locations on the plate through the opening 112 into the tubular jamb. The peripheral edges of the base plate are bevelled and merge into the jamb face to produce a finished, decorative appearance.

The connecting structure 104 detachably secures the base plate in the jamb opening 112 and comprises a mounting tongue 114 fixed to and projecting from the base plate adjacent one edge **115*a* and a latch element 116 projecting from a location adjacent the opposite edge 115*b*. The tongue 114 includes an offset portion 120 and a projecting tang portion 122 extending parallel to the base plate plane. The jamb wall is snugly received between the tang and the base plate to secure the base plate to the jamb. The support unit is installed by inserting the circuitry 92 and its supporting legs 102 into the opening 112 with the base plate angled relative to the plane of the jamb face so the tongue 114 projects through the opening 112** and along one edge.

When the jamb wall edge abuts the tongue offset portion 120 the base plate is rotated about the location of engagement to move the latch element 116 into the opening 112. The latch element 116 operates to secure the base plate to the jamb. The latch element 116 is formed by a resiliently deflectable projecting stem 124 having a ramp face 126 and an adjacent contoured keeper face 128 at its end. When the latch element is aligned with the jamb opening edge opposite the tongue 114 the base plate is pressed toward the opening 112 so the stem 124 resiliently deflects as the ramp face 126 passes across the edge of the opening 112. When the keeper face 128 is moved to engagement with the opening edge the keeper face contour forces the latch fully into the opening under the resilient force supplied by the deflected stem. The base plate snugly engages the jamb face before the stem 124 has fully straightened and relaxed so the base plate is effectively maintained biased into engagement with the edges of the jamb opening 112. Because it is smoothly contoured, the keeper face 128 can ride back and forth over the jamb opening edge to enable the support unit to be installed and removed as necessary for maintenance.

The alarm circuitry 92 comprises a conventional supporting substrate 130 (such as a phenolic "printed circuit" board or a "thick film" cermet element) carrying a network 132 of conductors and electrical circuit elements coacting to provide alarm functions. The substrate 130 is fixed to the projecting ends of the legs 102 by conventional fasteners so that the substrate 130 extends generally parallel to the base plate inside the hollow jamb structure. In the preferred embodiment of the invention, and as best seen in FIG. 3, the sensor 15 is supported on the substrate 130 immediately adjacent the base of the trackway 64 in which the position indicator 14 moves so that the sensor is actuated when the position indicator and sensor are proximate each other.

Figure 7:
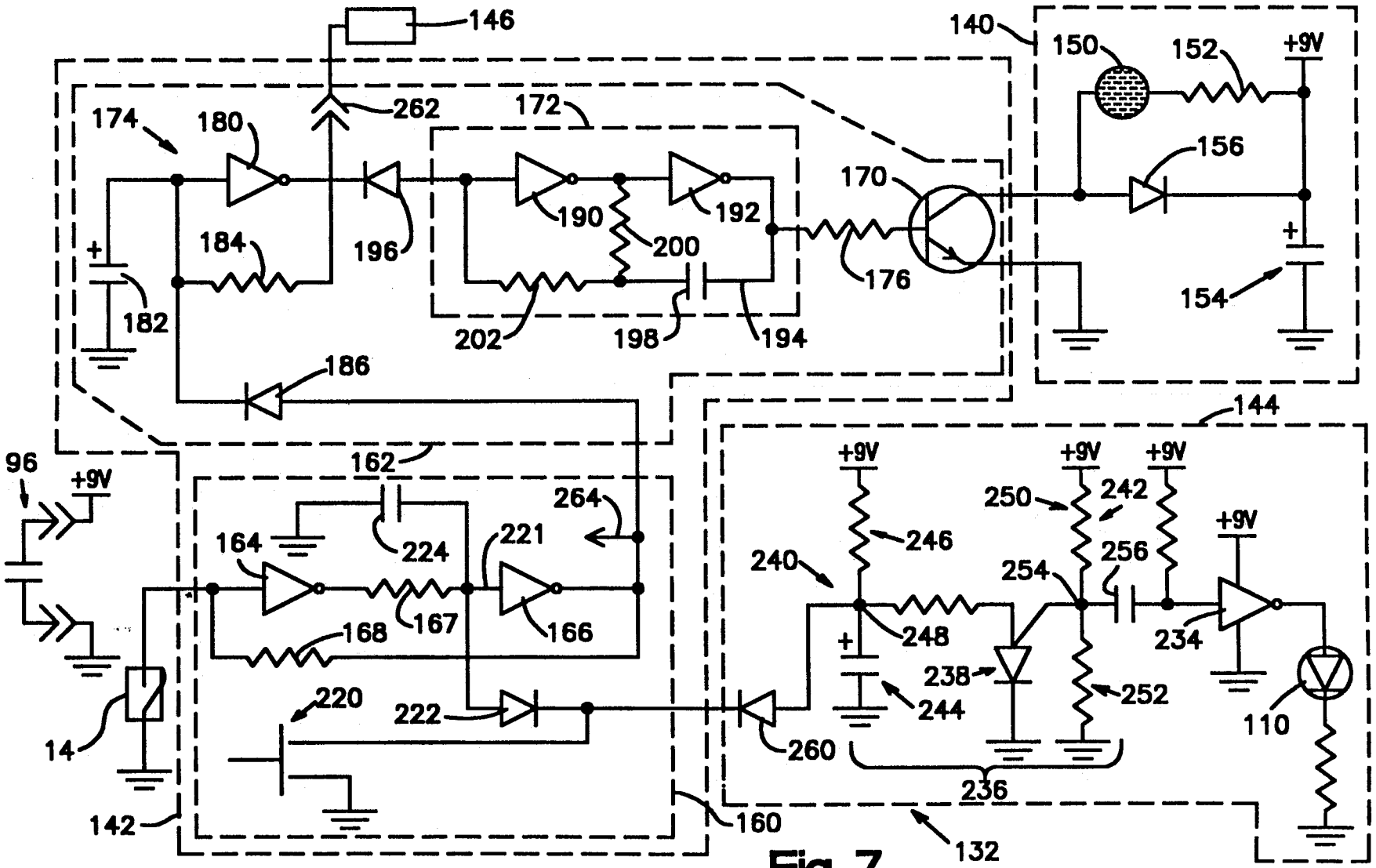
FIG. 7 is a schematic illustration of alarm unit circuitry forming part of the anti-intrusion window; and, FIG. 8 is an exploded view of a window frame assembly used with a preferred embodiment of the invention.

A preferred alarm circuit network 132 is schematically illustrated by FIG. 7 of the drawings and comprises an alarm driver circuit 140, a signal processing circuit !42, a status indicating circuit 144, and a radio frequency transmitter 146. When the alarm system 16 is armed, the alarm driver circuit 140 is activated by the signal processing circuit 142 whenever the position indicator 14 is detected by the sensor 15, even momentarily, to create a clearly audible intrusion signal.

The alarm driver circuit 140 produces a series of loud horn tones whenever the alarm driver circuit is activated and comprises a coil and diaphragm type horn 150 connected in an oscillator circuit comprised of a resistor 152, the horn coil and a diode 156. The signal processing circuit 142 connects the alarm driver circuit across the power supply 96 (preferably a low voltage direct current power supply or battery) at a rate resonant with the horn oscillator circuit so that the horn 150 sounds loudly whenever the sensor 15 detects the position indicator 14. A conventional power supply bypass capacitor 154 is connected in parallel with the oscillator circuit.

Figure 4:
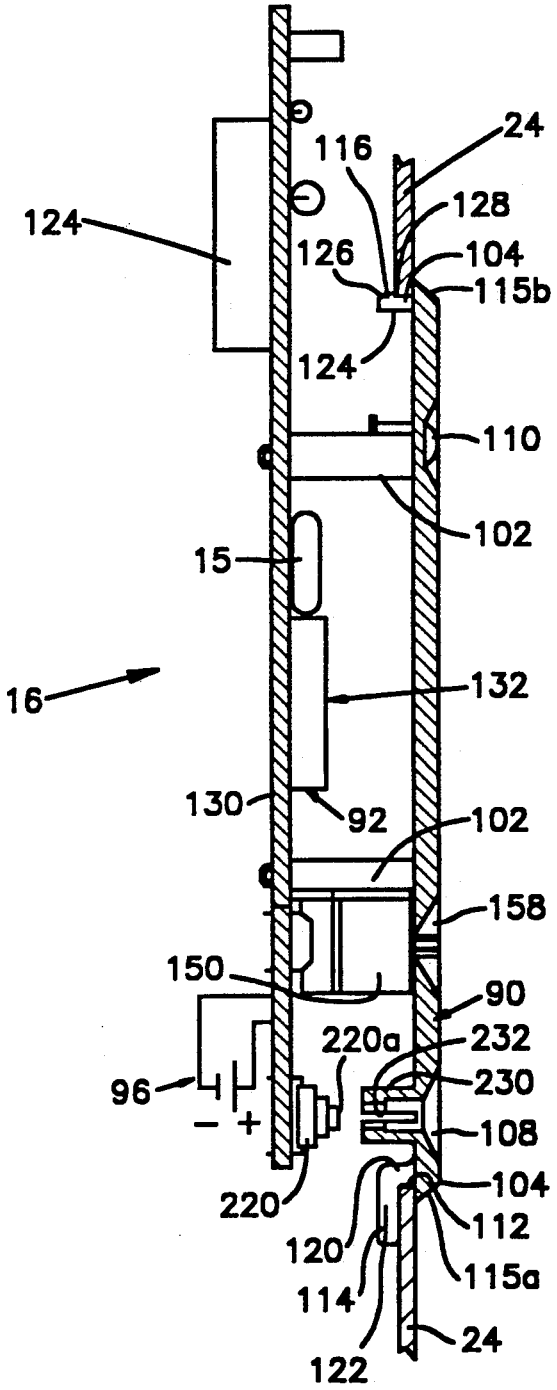
FIG. 4 is an enlarged cross sectional view seen approximately from the plane indicated by the line 4—4 of FIG. 1 with portions broken away.
Figure 5:
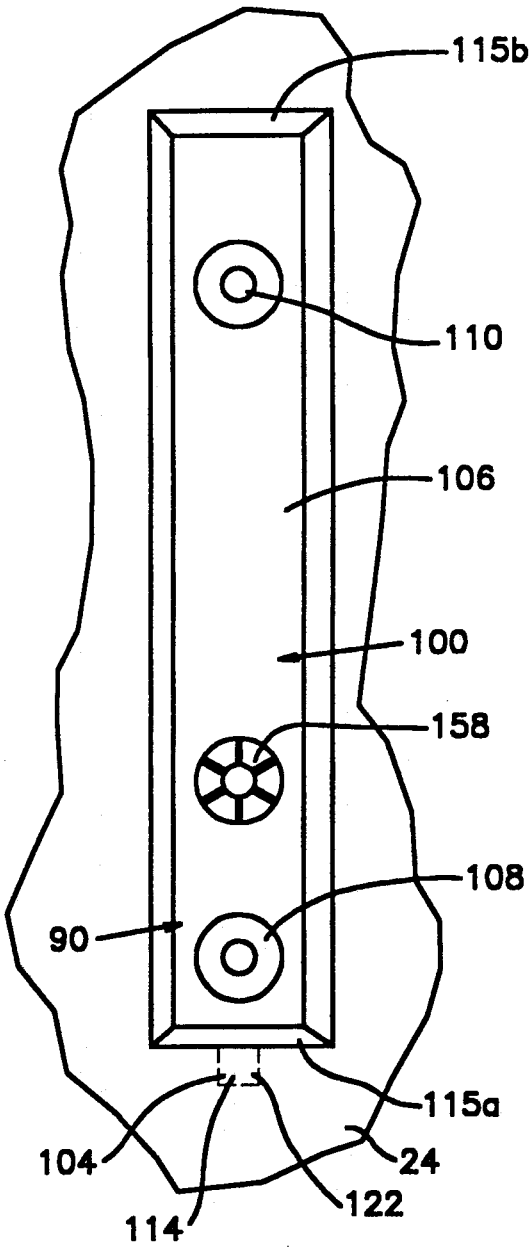
FIG. 5 is a cross sectional view seen approximately from the plane indicated by the line 5—5 of FIG. 4.

As illustrated by FIGS. 4 and 5 the horn is mounted on the substrate 130 immediately adjacent the panel 106 and the panel 106 is provided with a grill-work structure 158 through which the horn blasts are directed into the building. The horn 150 is schematically illustrates and can be of any suitable commercially available construction. In the preferred embodiment of the invention the horn 150 is a Star Micronics QMB-113.

The signal processing circuitry 142 detects even momentary signals from the sensor 15 and operates the horn 150 to produce a series of blasts until the alarm system is manually reset. In the illustrated system the signal processing circuitry 142 comprises a sensor responsive latching circuit 160 for producing a continuous alarm condition signal output in response to the sensor signal and an alarm signal conditioning circuit 162 for producing an alarm horn operating signal in response to the latching circuit output.

The latching circuit 160 is operated by the sensor 15 which, as noted, is a conventional reed switch having a magnetic contact arm which closes on a fixed contact whenever the position indicator magnet is in the vicinity. The preferred latching circuit comprises coacting inverters 164, 166 coupled between the sensor and the signal conditioning circuitry 162. The input of the inverter 164 is connected to the sensor, with the inverter output terminal connected to the input of the inverter 166 through a voltage dropping resistor 167. The output from the inverter 166 is coupled to the signal conditioning circuit and is fed back to the input terminal of the inverter 164 through a latching resistor 168.

Whenever the reed switch contacts close, the input to the inverter 164 is grounded resulting in the output from the inverter 166 going low and operating the signal conditioning circuit so the alarm sounds. At the same time the low output signal is fed back to the input via the latching resistor 168 so the latching circuit output remains low even though the reed switch contacts may reopen immediately.

The alarm signal conditioning circuit 162 comprises an output switch 170 for activating and deactivating the alarm driver circuit, and oscillator networks 172, 174 which coact to govern operation of the output switch 170 in response to the latching circuit output. In the preferred embodiment the oscillator network 172 operates the output switch 170 directly and runs at a frequency which changes the conductive state of the output switch at the natural frequency of the alarm driver circuit. This assures the efficient production of a loud horn tone. The oscillator network 174 is operated in response to an alarm condition output from the latching circuit 160 to enable and disable the oscillator network 172 at a rate suitable to produce a series of horn blasts to minimize power consumption and produce a more noticeable sound.

In the preferred embodiment the output switch 170 is an NPN transistor having its collector-emitter circuit connected in series between the horn 150 and the circuit ground with its base electrode connected to the network 172 via a resistor 176. The network 172 operates at about 2.6 kHz to change the conductive state of the switch 170 at that rate while the network 174 operates a frequency of about 3 Hz so the network 172 is enabled at that frequency. Accordingly the alarm horn 150 produces a series of alarm blasts at about 3 Hz.

The network 174 comprises an inverter 180, a capacitor 182, and a resistor 184 connected to form a low frequency oscillator connected to the latching circuit via a diode 186. Whenever the alarm system is armed but not triggered the latching circuit output is high and the capacitor 182 is charged. When an alarm condition is sensed the latching circuit output goes low which "reverse biases" the diode 186 and prevents it from conducting. The capacitor 182 discharges through the resistor 184 until the inverter input is sufficiently low to change the state of the inverter. When this occurs the inverter output goes high and the capacitor 182 is charged again via the resistor 184. When the capacitor charge level is sufficiently high the inverter changes state again and the process is repeated at a rate of 3 Hz. until the latching circuit output goes high (indicating the alarm system has been reset or turned off) precluding further oscillations.

The oscillator 172 is formed of inverters 190, 192 interconnected by a feedback network 194 to form a so-called "racetrack" oscillator activated and deactivated by the oscillator 174. The oscillators 172 and 174 are coupled by a diode 196 which is conductive when the output of the inverter 180 is low and nonconductive when that inverter output is high. When the diode 196 is nonconducting the oscillator 172 runs freely at 2.6 kHz. The frequency is determined by the time constant of the feedback network 194 which includes a capacitor 198, and resistors 200 and 202.

When the diode 196 is initially rendered nonconductive the input to the inverter 190 is enabled to go high, which it does as a result of the capacitor 198 charging through the resistor 200 from the output of the inverter 180. When the input to the inverter 190 goes high its output goes low and the output of the inverter 192 consequently goes high. This renders the transistor 170 conductive so the horn 150 is energized. Meanwhile the capacitor 198 discharges via the resistor 200 until the input to the inverter 190 goes low again. This causes that inverter output to go high, resulting in the output of the inverter 192 going low and turning off the transistor 170. At the same time the capacitor 198 is recharged from the output of the inverter 190 through the resistor 200. The resistor 202 prevents the input of the inverter 190 from going below ground voltage whenever the output of the inverter 192 goes low.

This sequence of events continues at the frequency referred to until the diode 196 is rendered conductive again which precludes the input of the inverter 190 from going high. The effect is that the alarm horn circuit is energized and de-energized by the transistor 170 as its conductive state is switched at 2.6 kHz and an apparently continuous horn blast is sounded. Because the low frequency oscillator periodically deactivates the high frequency oscillator, the horn blasts intermittently at the frequency of the low frequency oscillator i.e. about three Hertz. The horn 150 is fixed to the substrate 130 immediately adjacent the panel 106 in alignment with an array of slots 219 which transmit the horn blasts efficiently into the room in which the window is installed.

The alarm can be stopped by manually actuating a reset switch 220 with the operating key 94. In the preferred embodiment the reset switch 220 is a normally open microswitch, or equivalent, having its operating plunger 220*a* fixed to the substrate 130 in line with the operating key receptacle 108 (see FIG. 4) and its contacts (FIG. 7) connected in a circuit from a junction 221 at the input of the inverter 166 to ground through a diode 222. When the key 94 is inserted to reset the alarm, the reset switch contacts are closed and the inverter 166 changes state because its input is grounded through the diode 222 and the reset switch 220.

The reset switch contacts need only be closed momentarily to disable the alarm and the alarm system is immediately rearmed as soon as the reset switch contacts reopen. In FIG. 7 the junction 221 is illustrated connected to the circuit ground through a transient filtering capacitor 224. The capacitor 224 is small and discharges immediately when the reset switch 220 is closed so there is no noticeable delay in resetting the alarm when the key is pressed into its receptacle to close the reset switch 220. Likewise, when the key is withdrawn, or merely retracted slightly from the switch, the alarm circuitry is immediately armed again because the capacitor 224 rapidly charges.

Because the window and alarm system permit window cleaning as well as enabling opening the window for ventilation without triggering the alarm, the alarm is typically maintained in its armed state all the time. However, the alarm system may be manually turned off by the key 94 and reset switch 220 if that should ever become desirable.

Figure 6:
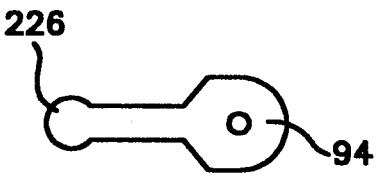
FIG. 6 illustrates an anti-intrusion window alarm unit operating key.

As illustrated by FIGS. 4 and 6 the key 94 and its receptacle 108 are constructed to provide a detent mechanism for maintaining the reset switch contacts closed when the key is fully inserted in the receptacle and left there. The projecting key end 226 is formed to define an enlarged spherically curved bead-like structure (See FIG. 6). The receptacle 108 is provided by an opening in the control panel 106 and key engaging spring legs 230 projecting toward the reset switch plunger from the backside of the control panel. The rearwardly projecting spring leg ends 232 are enlarged and the legs extend adjacent the axis of the receptacle opening so that when the key 94 is inserted the key end 226 moves between the leg ends 232 and resiliently deflects the legs. When the key end 226 moves beyond the leg ends 232 the legs spring back towards each other again. This action maintains the key end gripped by the leg ends and positioned for continuously depressing the reset switch plunger 220*a*.

The detent mechanism also provides an operational "feel" to the key so the user of the window receives a tactile indication when the key has actuated the reset switch 220 as well as when he key has been withdrawn sufficiently from the reset switch that the alarm system is re-armed.

The status indicating circuit 144 produces a sensible indication that when the alarm system is armed by, in the preferred embodiment of the invention, operating the status indicator 110 to produce a blinking light at the control panel surface. The light is visible within the room in which the window is installed. The status indicating circuit comprises the indicator 110, formed by a light emitting diode (LED), an inverter 234 for activating the LED and a timing circuit 236 for controlling the inverter.

The timing circuit produces periodic inverter activating pulses whenever the reset switch 220 is open. The timing circuit comprises an electronic switch 238 formed by a programmable unijunction transistor (PUT) having its control electrodes connected between respective outputs of a charging circuit 240 and a voltage divider circuit 242. When the reset switch is open a capacitor 244 in the charging circuit charges via a resistor 246 to create a positive going voltage at an output junction 248. The voltage divider circuit is formed by resistors 250, 252 and an output junction 254 connected to the PUT. When the voltage at the junction 248 increases to a level which is one diode voltage drop above the voltage at the junction 254 the PUT is rendered conductive and establishes a highly conductive path in parallel with the resistor 252. Consequently the voltage at the junction 254 abruptly drops to circuit ground and the capacitor 244 discharges through the PUT.

The junction 254 is coupled to the input of the inverter 234 by a capacitor 256 so that when the PUT is rendered conductive the negative going voltage at the junction 254 reduces the input voltage level at the inverter input resulting in the inverter output voltage going high and energizing the LED. When the charging circuit capacitor 244 discharges sufficiently that the PUT becomes nonconductive again the inverter input voltage level goes high and the LED is turned off. This process repeats itself at a frequency determined primarily by the values of the resistor 246 and the capacitor 244. The circuit elements in the status circuitry chosen to produce impedances which are as large as practical so minimal current is drawn by the circuitry. The LED blinks every few seconds until the reset switch 220 is closed which interrupts the status circuitry operation.

The reset switch 220 is closed to disable the charging circuit and prevent the LED from being illuminated. The reset switch 220 and status indicating circuitry 132 are coupled by a diode 260 connected between the junction 248 and the reset switch contacts. The diode 260 is poled so that when the reset switch contacts close the diode conducts from the junction 248 to circuit ground. This prevents charging the capacitor 244.

The radio frequency transmitter 146 is of any conventional or suitable type and is operable from the alarm system to transmit an R.F. signal to an appropriate receiver so that a remote alarm can be produced. By way of example, the transmitted radio signal may be used to operate an automatic telephone dialer in the building which then signals an alarm condition to a remote location. Depending on the type of transmitter selected for use, the transmitter input may be connected to the alarm circuitry at transmitter output terminals 262 or 264.

The power supply 96 can be of any suitable low voltage type, but in the preferred embodiment of the invention the power supply is a conventional 9 volt battery connected to the substrate by power lines and detachable battery terminal connectors. Hence the battery 96 can be removed and replaced should it lose power over time. Removal and replacement is made relatively easy by the support unit construction.

While a single preferred embodiment of the invention has been illustrated and described in detail, the present invention is not to be considered limited to the precise construction disclosed. Various adaptations, modifications and uses of the invention may occur to those skilled in the art to which the invention relates and the intention is to cover hereby all such adaptations, modifications and uses which fall within the spirit or scope of the appended claims.

I claim:

1. An anti-intrusion window comprising:

a frame assembly adapted to be attached to a building structure;

a sash assembly supported by said frame assembly for movement with respect to said frame assembly along a path of travel;

a position indicator supported by one of said assemblies;

a sensor supported by the other of said assemblies so that said sensor and said position indicator move with respect to one another when said sash assembly is moved along said path of travel, said sensor effective to detect the presence of said position indicator near said sensor; and, an alarm system for triggering an alarm in response to the momentary presence of said position indicator near said sensor;

said sash assembly comprising means for moving said sash assembly along a second path of travel between a position on said first path of travel and a cleaning position wherein opposite sides of said sash are accessible for cleaning from the same side of the window and said sensor and said position indicator are supported by said assemblies such that movement along said second path to said cleaning position maintains said position indicator and said sensor apart to prevent said momentary presence.

2. An anti-intrusion window according to claim 1 wherein said position indicator is a magnet and said sensor is responsive to the momentary presence of a magnetic field produced by said.

3. An anti-intrusion window according to claim 1 wherein said position indicator is supported by said sash assembly.

4. An anti-intrusion window according to claim 1 wherein said sash assembly is movable along said first path between a closed position and a range of open ventilating positions, said position indicator and said sensor supported by said assemblies to remain spaced apart throughout a predetermined range of open ventilating positions of said sash to prevent said momentary presence.

5. An anti-intrusion window according to claim 1 where said means for moving said sash assembly along a second path of travel comprises a pivot means allowing said sash assembly to pivot away from said frame assembly.

6. An anti-intrusion window according to claim 1 wherein said alarm system is recessed in the frame assembly.

7. An anti-intrusion window according to claim 1 wherein said frame assembly comprises a cavity and wherein said alarm system comprises an support unit, said support unit comprising:

a face plate;

a circuit board; and, a latch for securing said integral unit to said frame assembly so that, except for said face plate, said integral unit is substantially within said cavity when said support unit is secured to said frame assembly.

8. An anti-intrusion window according to claim 7 wherein said latch permits snap-out removal of said unit from said cavity and snap-in positioning of said unit into said cavity.

9. An anti-intrusion window according to claim 7 wherein said support unit comprises a self-contained power supply.

10. An anti-intrusion window according to claim 1, said alarm system further comprises a status circuit which produces an intermittent signal indicating that the alarm system is in an armed state.

11. An anti-intrusion window according to claim 1 wherein said alarm system comprises a signal conditioning circuit which intermittently enables an alarm signal upon said triggering.

12. An anti-intrusion window according to claim 1 wherein said alarm system comprises an signal processing circuit which produces a pulsed on-and-off signal and a continuous output signal upon said triggering.

13. An anti-intrusion window according to claim 1 wherein said alarm system comprises a status circuit for producing a status signal when said alarm system is armed.

14. An anti-intrusion window according to claim 1 wherein said alarm system comprises an input circuit for providing a continuous output signal in response to a pulse signal from said sensor, said input circuit comprising a reset means for discontinuing said continuous output signal and re-arming said alarm system.

15. An anti-intrusion window according to claim 14 wherein said alarm system further comprises a signal conditioning circuit for converting said continuous output signal from said input circuit to a pulsed on-and-off signal for controlling said alarm.

16. An anti-intrusion window according to claim 1 wherein said alarm system comprises a radio frequency transmitter for transmitting a signal in response to said momentary presence.

17. An anti-intrusion window comprising:

a frame assembly adapted to be attached to a building structure;

a sash assembly constrained and guided by said frame assembly for movement along a first path between a closed position and a range of open positions, said sash assembly comprising means for moving said sash assembly with respect to said frame assembly along a second path between a position on said first path and a cleaning position wherein opposite sides of the sash are accessible for cleaning from the same side of the window;

a position indicator supported by one of said assemblies;

a sensor supported by the other of said assemblies and spaced a predetermined distance from said position indicator when said sash is in a closed position, said position indicator and said sensor moving relative to each other when said sash assembly is moved along said first path, said sensor producing a signal in response to the momentary presence of said position indicator when the position indicator and sensor are adjacent each other during said relative movement; and, an alarm system supported by one of said assemblies for indicating unauthorized opening of said window, said alarm system having setting means for operating said alarm system between an armed state and an unarmed state, said alarm system being coupled to said sensor for triggering an alarm in response to said signal.

18. An anti-intrusion window according to claim 17 wherein said sensor and said position indicator are supported by said assemblies such that movement of said sash along said second path to a cleaning position maintains said position indicator and said sensor apart to prevent said momentary presence.

19. A replacement window having an integral alarm system comprising:

a frame assembly comprising tubular extruded members connected to form an assembly attachable to a building;

a sash assembly supported by said frame assembly for movement with respect to said frame assembly from a closed position along a path of travel between open positions;

a position indicator supported by one of said assemblies;

a sensor supported by the other of said assemblies, said sensor and said position indicator moving relatively when said sash assembly moves along said path of travel so that said position indicator and said sensor are adjacent when said sash moves to a predetermined open position, said sensor comprising an element responsive to the proximity of said position indicator; and, an alarm system for triggering an alarm in response to the momentary proximity of said position indicator and sensor, said alarm system comprising a support unit detachably connected to the frame assembly and alarm circuitry supported by said unit within a tubular frame assembly member;

said alarm circuitry comprising an alarm producing driver circuit and a signal processing circuit responsive to said sensor for operating said alarm driver circuit, said signal processing circuitry comprising a latching circuit for producing an alarm condition signal in response to detection of said position indicator by the sensor, said latching circuit and said alarm driver circuit coupled together.

20. The replacement window claimed in claim 19 wherein said support unit comprises a base plate, alarm circuitry supporting structure projecting from the base plate for supporting said circuitry at a location spaced from said base plate and connecting structure for detachably securing the unit to said frame assembly, said connecting structure comprising a latch structure interacting between the base plate and the frame assembly so that said base plate is secured to said frame assembly with said circuitry supported within a tubular frame assembly member.

21. The replacement window claimed in claim 19 wherein said sensor comprises a magnetic field responsive element and said position indicator comprises a magnet, said magnetic field responsive element coupled to said latching circuit and effective to activate said latching circuit when the sensor and the position indicator are momentarily proximate.

22. The replacement window claimed in claim 19 further including a transmitter unit activated by said latching circuit for transmitting an alarm condition signal.

23. The replacement window claimed in claim 19 wherein said alarm circuit further includes a power supply, said power supply supported by said support unit within a tubular frame assembly member.

24. An anti-intrusion window comprising:

a frame assembly adapted to be attached to a building structure;

a sash assembly constrained and guided by said frame assembly for movement along a first path between a closed position and a range of open positions, said sash assembly comprising means for moving said sash assembly with respect to said frame assembly along a second path between a position on said first path and a cleaning position wherein opposite sides of the sash are accessible for cleaning from the same side of the window;

a second sash assembly constrained and guided by said frame assembly for movement along a third path parallel to and in the direction of said first path between a closed position and a range of open positions, said second sash assembly comprising means for moving said second sash assembly with respect to said frame assembly along a fourth path between a position on said third path and a cleaning position wherein opposite sides of the second sash are accessible for cleaning from the same side of the window;

a position indicator supported by one of said assemblies;

a sensor supported by another of said assemblies and spaced a predetermined distance from said position indicator when each of said first and second sash assemblies is in a closed position, said position indicator and said sensor moving relative to each other when said sash assembly supporting one of them is moved from its closed position to an open position, said sensor producing a signal in response to the momentary presence of said position indicator when the position indicator and sensor are adjacent each other during said relative movement; and an alarm system supported by one of said assemblies for indicating unauthorized opening of said window, said alarm system having setting means for operating said alarm system between an armed state and an unarmed state, said alarm system being coupled to said sensor for triggering an alarm in response to said signal.

25. A replacement window having an integral alarm system comprising:

a frame assembly comprising tubular extruded members connected to form an assembly attachable to a building;

a sash assembly comprising tubular extruded members connected together and supported by said frame assembly for movement with respect to said frame assembly from a closed position along a path of travel between open positions;

a second sash assembly comprising tubular extruded members connected together and supported by said frame assembly for movement with respect to said frame assembly and said first sash assembly along a second path of travel parallel to said first path of travel between a closed position and open positions;

a position indicator supported by one of said assemblies;

a sensor supported by another of said assemblies;

said sensor and said position indicator moving relatively when the sash assembly carrying said position indicator or said sensor moves along its path of travel so that said position indicator and said sensor are adjacent when said sash assembly moves to a predetermined open position, said sensor comprising an element responsive to the proximity of said position indicator; and, an alarm system for triggering an alarm in response to the momentary proximity of said position indicator and said sensor, said alarm system comprising a support unit detachably connected to one of said assemblies and alarm circuitry supported by said unit within one of said tubular extruded members;

said alarm circuitry comprising an alarm producing driver circuit and a signal processing circuit responsive to said sensor for operating said alarm driver circuit, said signal processing circuitry comprising a latching circuit for producing an alarm condition signal in response to detection of said position indicator by the sensor, said latching circuit and said alarm driver circuit coupled together.

26. The replacement window claimed in claim 25 wherein said support unit comprises a base plate, alarm circuitry supporting structure projecting from the base plate for supporting said circuitry at a location spaced from said base plate and connecting structure for detachably securing the unit to said associated tubular extruded member, said connecting structure comprising a latch structure interacting between the base plate and the tubular extruded member so that said base plate is secured to said tubular extruded member with said circuitry supported within said tubular extruded member.

27. The replacement window claimed in claim 25 wherein said sensor comprises a magnetic field responsive element and said position indicator comprises a magnet, said magnetic field responsive element coupled to said latching circuit and effective to activate said latching circuit when the sensor and the position indicator are momentarily proximate.

28. The replacement window claimed in claim 25 further including a transmitter unit activated by said latching circuit for transmitting an alarm condition signal.

* * * * *